US007795518B2

(12) United States Patent
Yoshino et al.

(10) Patent No.: US 7,795,518 B2
(45) Date of Patent: Sep. 14, 2010

(54) OPERATING DEVICES AND METHODS FOR ELECTRONIC PERCUSSION INSTRUMENT

(75) Inventors: Kiyoshi Yoshino, Hamamatsu (JP); Hideaki Yamane, Hamamatsu (JP)

(73) Assignee: Roland Corporation, Hamamatsu, Shizuoka-ken (JP)

( * ) Notice: Subject to any disclaimer, the term of this patent is extended or adjusted under 35 U.S.C. 154(b) by 0 days.

(21) Appl. No.: 12/265,663

(22) Filed: Nov. 5, 2008

(65) Prior Publication Data

US 2009/0241755 A1 Oct. 1, 2009

(30) Foreign Application Priority Data

Mar. 28, 2008 (JP) ..... 2008-086180

(51) Int. Cl.
*G10D 1/02* (2006.01)

(52) U.S. Cl. ..... 84/411 R; 84/104; 84/107; 84/421; 84/723

(58) Field of Classification Search ..... None
See application file for complete search history.

(56) References Cited

U.S. PATENT DOCUMENTS 4,479,412 A * 10/1984 Klynas ..... 84/730
5,076,131 A * 12/1991 Patterson ..... 84/421
5,262,585 A * 11/1993 Greene et al. ..... 84/645
5,691,492 A 11/1997 May
5,841,052 A * 11/1998 Stanton ..... 84/600
5,856,628 A * 1/1999 Noguchi et al. ..... 84/738
6,399,869 B1 * 6/2002 Sagastegui ..... 84/738
2002/0062729 A1 * 5/2002 Sagastegui ..... 84/738
2006/0174756 A1 * 8/2006 Pangrle ..... 84/724
2008/0163739 A1 * 7/2008 Mori ..... 84/421
2008/0229902 A1 * 9/2008 Mori et al. ..... 84/421

FOREIGN PATENT DOCUMENTS

JP 11-502640 3/1999
JP 2007-286104 11/2007

* cited by examiner

*Primary Examiner*—Marlon T Fletcher
(74) *Attorney, Agent, or Firm*—Foley & Lardner LLP

(57) ABSTRACT

An operating device for use with a musical instrument may allow for a supporting member configured to be supported by a user to be operatively connected to a percussion instrument with a case, which may contain an electronic circuit for processing a signal produced by striking a striking surface of the percussion instrument. The case may be arranged between the electronic percussion instrument and the supporting member. The case and the electronic percussion instrument may be configured to be moveable relative to the user.

23 Claims, 8 Drawing Sheets

OPERATING DEVICES AND METHODS FOR ELECTRONIC PERCUSSION INSTRUMENT

CROSS-REFERENCE TO RELATED PATENT APPLICATIONS

Embodiments of the present invention relate to Japan Priority Application 2008-086180, filed Mar. 28, 2008 including the specification, drawings, claims, and abstract, and is incorporated herein by reference in its entirety and is a basis for priority.

BACKGROUND OF THE INVENTION

Japanese PCT translation H11-502640 discloses attaching an acoustic percussion instrument (e.g., a snare drum or a tomtom) to a holding fixture for marching and the like to allow a musical performance to be conducted while parading and performing.

FIG. 8 of the present application illustrates an example of a previous type of electronic percussion instrument and case. As shown in FIG. 8, an electronic percussion instrument 200 has a head 213, which is formed with a flexible, permeable material, such as mesh and the like, a rim 214, which is arranged surrounding the head 213, and a case 210 containing an electronic circuit (not shown).

However, the electronic percussion instrument 200 is meant to be stationary, for example, attached to a snare stand (not shown) and placed on the floor. Furthermore, the electronic percussion instrument 200 is not adapted to be fastened to a holding fixture worn by a user for marching and the like to allow a musical performance to be conducted while parading and performing.

SUMMARY OF THE INVENTION

Embodiments of the present invention relate to an operating device for use with an electronic percussion instrument and, particular embodiments relate to an operating device that can be attached to and used with an electronic percussion instrument, and to a holding fixture supported by a performer-user for marching and the like to allow a musical performance to be conducted while parading and performing.

An operating device in accordance with an embodiment of the present invention may include, but is not limited to, an electronic percussion instrument, a holding fixture, a case, an electronic circuit, an instrument attachment member, and a holding fixture attachment member. The electronic percussion instrument may comprise a pad. The holding fixture may be configured to be supported by a user. The case may be arranged between the holding fixture and the electronic percussion instrument. The electronic circuit may be provided within the case. The electronic circuit may be for processing a signal produced by striking a striking surface of the pad of the electronic percussion instrument. The instrument attachment member may be for operatively connecting the electronic percussion instrument to the case. The holding fixture attachment member may be for operatively connecting the holding fixture to the case.

Because the case is operatively connected to the holding fixture and the electronic percussion instrument, the electronic percussion instrument can be operatively connected to or otherwise supported by the holding fixture as well. Thus, a performer-user can conduct a musical performance with the electronic percussion instrument while parading and performing, for example, while marching and the like.

In addition, rigidity may be maintained because the case may be formed in a box form. Thus, the electronic percussion instrument may be stabilized and fastened to the case and the holding fixture. Moreover, the case may be arranged between the holding fixture supported on the body of the performer-user such that the case may be arranged closer to the performer-user than the electronic percussion instrument.

In various embodiments, an operating panel may be provided on the case. The operating panel may have a plurality of controls. In some embodiments, the plurality of controls may be arranged on the operating panel at a position lower than the striking surface of the pad. Therefore, because the operators may be arranged in a place where the performer-user's hand can easily reach, the operability of the operators may be improved. Accordingly, inadvertent striking of the operators may be mitigated. In addition, because the case may include an operating panel comprising a plurality of operators positioned lower than the striking surface of the pad, mistakes due to the performer-user inadvertently striking the case may be mitigated.

The electronic percussion instrument may be arranged such that a specified space is provided between the electronic percussion instrument and the holding fixture. This may effectively use space between the electronic percussion instrument and the holding fixture.

In various embodiments, the operating device may further include a circuit board containing the electronic circuit. The case may have a main body. The circuit board may be arranged within the main body of the case such that the circuit board is approximately perpendicular to the striking surface of the pad.

Because the printed circuit board may be attached to the housing and arranged perpendicular to the striking surface of the pad, damage to the printed circuit board may be mitigated. In other words, because the direction in which the vibrations produced by the striking of the pad and the printed circuit board are roughly perpendicular, the printed circuit board may be less likely to bend or warp, and thus damage to the printed circuit board from the vibrations may be reduced. Additionally, placing the case, which contains the electronic circuit for processing a signal produced by striking the pad, in the specified space may further effectively use the specified space provided between the electronic percussion instrument and the holding fixture.

In various embodiments, the case may further include an upper reinforcing plate and a lower reinforcing plate. The main body of the case may have a top opening and a bottom opening. The upper reinforcing plate may be for covering the top opening of the main body of the case. The lower reinforcing plate may be for covering the bottom opening of the main body of the case. The upper reinforcing plate and the lower reinforcing plate may be parallel to the striking surface of the pad. The main body of the case may be supported between the upper reinforcing plate and the lower reinforcing plate. In some embodiments, the instrument attachment member, the holding fixture attachment member, and the upper reinforcing plate may be formed as a single unit.

Accordingly, because the instrument attachment member, the holding fixture attachment member, and the upper reinforcing plate may be configured as a single unit, the vibrations due to the striking of the pad may be transmitted to the holding fixture via the instrument attachment member, the upper reinforcing plate, and the holding fixture attachment member. Therefore, the relevant vibrations transmitted to the main body of the case containing the circuit board may be reduced to mitigate damage to the circuit board.

An operating device for a musical instrument in accordance with an embodiment of the present invention may include, but is not limited to, a percussion instrument, a supporting member, a casing, and an electronic circuit. The percussion instrument may comprise a striking surface. The supporting member may be configured to be supported by a user. The casing may be arranged between the supporting member and the percussion instrument. The casing may be operatively connected to the percussion instrument and the supporting member. The electronic circuit may be provided within the casing. The electronic circuit may be for processing a signal produced by striking the striking surface of the percussion instrument.

In various embodiments, the percussion instrument and the casing may be configured to be moveable relative to the supporting member.

In various embodiments, the operating device may include an attachment member for operatively connecting the percussion instrument to the casing. In other embodiments, the musical instrument may include an attachment member for operatively connecting the supporting member to the casing.

In various embodiments, the supporting member may be configured to be worn by the user.

In various embodiments, the casing may comprise an operating panel having a plurality of controls. In some embodiments, the plurality of controls may be positioned at a position lower than the striking surface of the percussion instrument.

In various embodiments, the operating device may further include a circuit board comprising the electronic circuit. The circuit board may have a longitudinal dimension. The circuit board may be arranged within the casing such that the longitudinal dimension of the circuit board is approximately perpendicular to the striking surface of the percussion instrument.

In various embodiments, the percussion instrument may be an electronic percussion instrument. In various embodiments, the percussion instrument may comprise a pad.

A method of making an operating device for use with a musical instrument in accordance with an embodiment of the present invention may include, but is not limited to, (i) providing a percussion instrument, the percussion instrument comprising a striking surface; (ii) providing a supporting member configured to be supported by a user; (iii) arranging a casing between the supporting member and the percussion instrument, the casing operatively connected to the percussion instrument and the supporting member; and (iv) providing an electronic circuit within the casing, the electronic circuit for processing a signal produced by striking the striking surface of the percussion instrument.

In various embodiments, the method may further include providing an operating panel on the casing. The operating panel may have a plurality of controls arranged at a position lower than the striking surface of the percussion instrument.

In various embodiments, the method may further include supporting the electronic circuit on a circuit board; and supporting the circuit board in the casing such that the circuit board is approximately perpendicular to the striking surface of the percussion instrument.

In various embodiments, the method may further include providing an upper reinforcing plate on an upper portion of the casing; and providing a lower reinforcing plate on a lower portion of the casing. The upper reinforcing plate may be parallel to the striking surface of the percussion instrument. The casing may be supported between the upper reinforcing plate and the lower reinforcing plate.

BRIEF DESCRIPTION OF THE DRAWINGS

FIG. 3(*b*) illustrates a cross-section drawing of the attachment member of FIG. 3(*a*) viewed along a line IIIb-IIIb in FIG. 3(*a*);

FIG. 4(*b*) illustrates a locking lever according to an embodiment of the present invention;

FIG. 5(*b*) illustrates a rotating shaft section according to an embodiment of the present invention viewed from a direction of an arrow Vb in FIG. 5(*a*);

FIG. 5(*c*) illustrates the case of FIG. 5(*a*) viewed from a direction of an arrow Vc in FIG. 5(*a*);

DETAILED DESCRIPTION OF THE PREFERRED EMBODIMENTS

Figure 1:
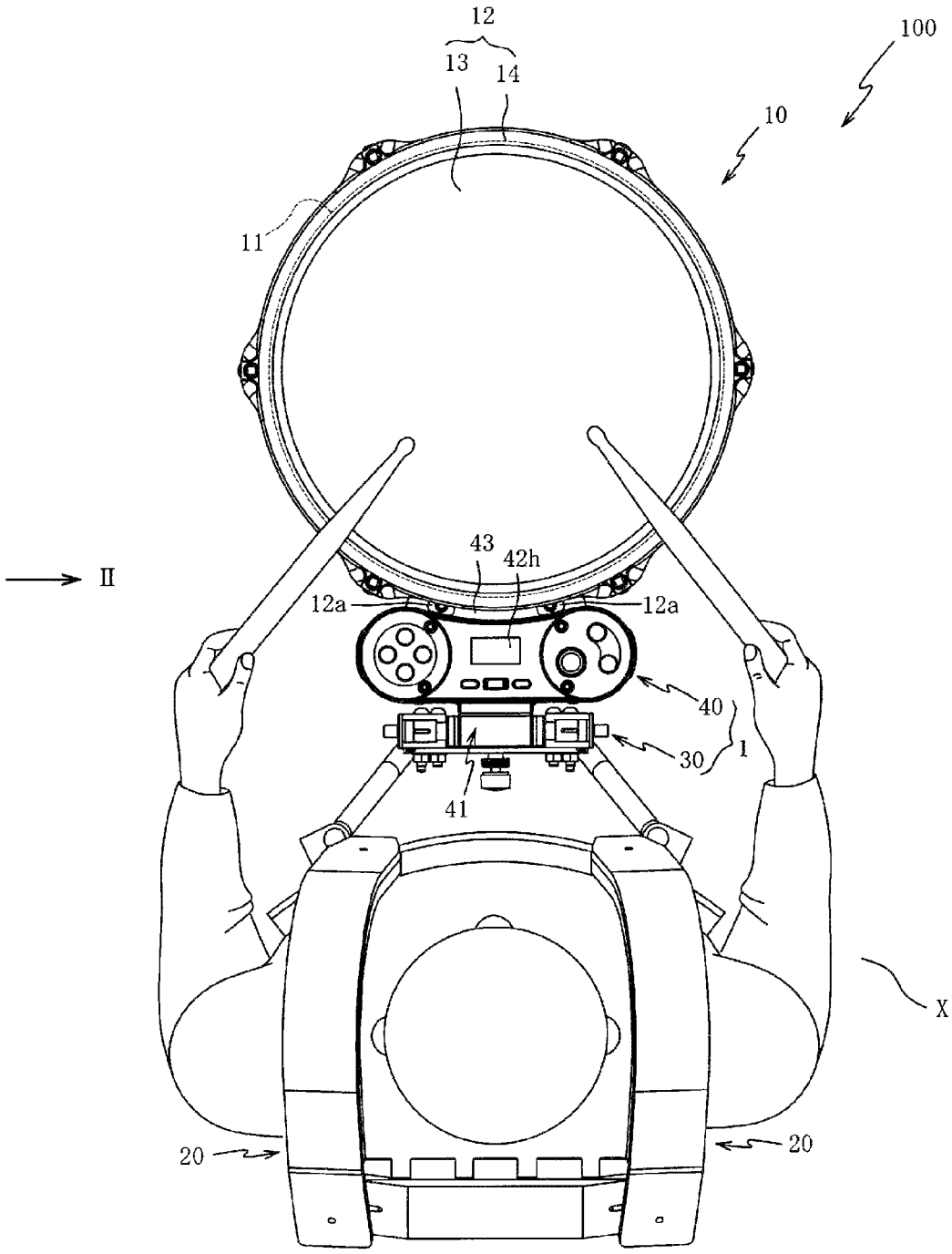
FIG. 1 illustrates an electronic percussion instrument system according to an embodiment of the present invention.
Figure 2:
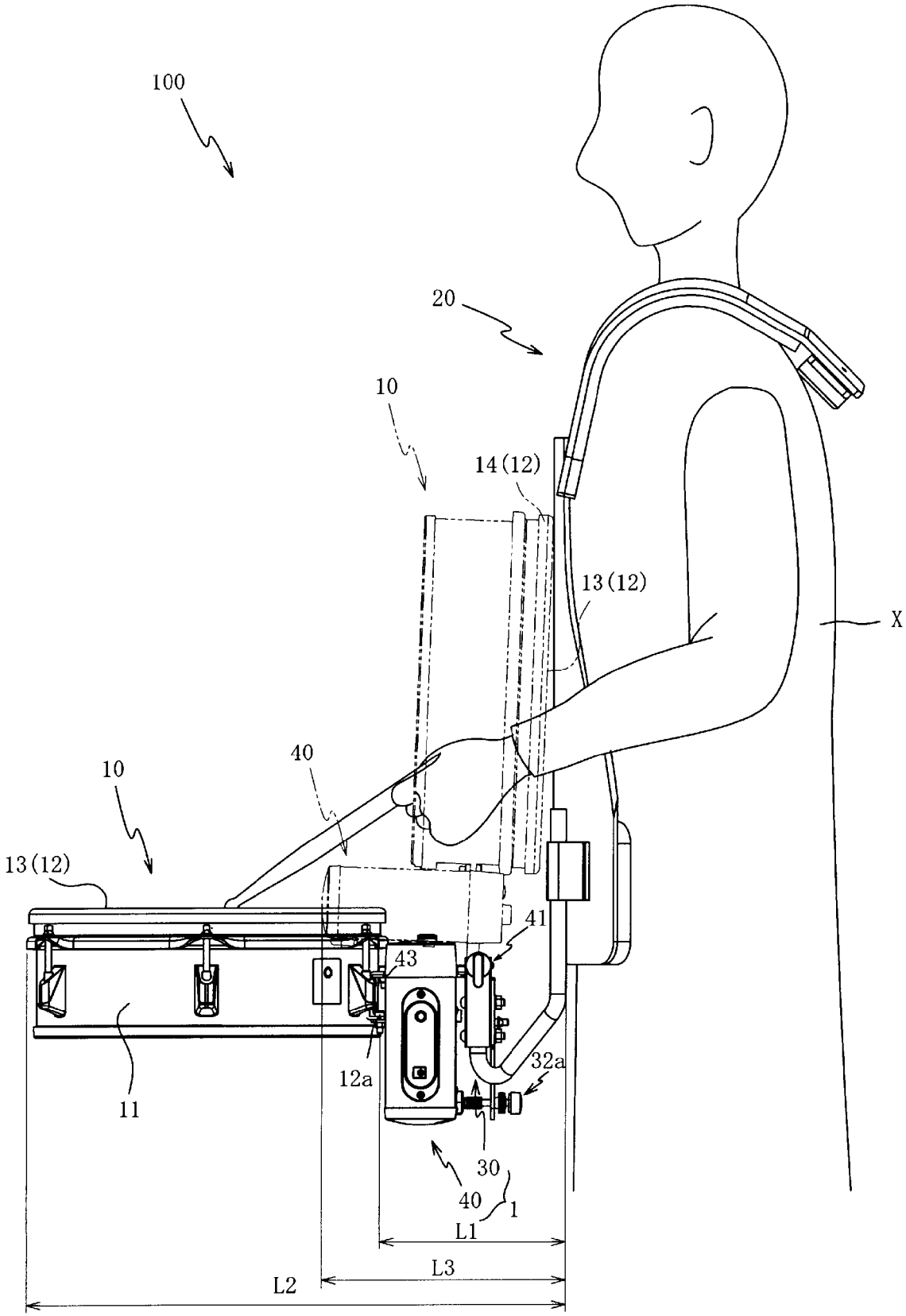
FIG. 2 illustrates a side view of the electronic percussion instrument system of FIG. 1 viewed from a direction of an arrow II in FIG. 1.

FIGS. 1 and 2 illustrate an electronic percussion instrument system 100 according to an embodiment of the present invention. The electronic percussion instrument system 100 may be a percussion instrument for marching, or the like. The electronic percussion instrument system 100 may comprise, but is not limited to, an electronic percussion instrument 10, a holding fixture 20, and an operating device 1.

In some embodiments, the electronic percussion instrument 10 may be for example, but not limited to, an electronic drum, or other electronic percussion instrument, which can be played with or otherwise performed upon using a drum stick, or the like.

The electronic percussion instrument 10 may comprise, but is not limited to, a main body 11 and a pad 12. The pad 12 may be arranged on a top surface of the main body 11. The electronic percussion instrument 10 may be arranged a specified distance L1 away from a performer-user X such that the pad 12 can be struck easily by the performer-user X.

The main body 11 may be a body for serving as a frame of the electronic percussion instrument 10. In some embodiments, the main body 11 may have a cylindrical shape. In further embodiments, the main body 11 may be formed from a resin material.

The pad 12 may include a circular head 13. The head 13 may be made of a permeable cloth, such as mesh, or the like. The pad 12 and the head 13 may be arranged across a top surface of the main body 11. A ring-shaped rim 14 may surround the head 13. Vibrations may be produced by striking the head 13 and/or the rim 14. The vibrations produced by striking the rim 14 may be detected by a rim sensor 101 (refer to FIG. 7). The vibrations produced by striking the head 13 may be detected by a head sensor 102 (refer to FIG. 7). In some embodiments, an angle of the striking surface of the pad 12 (i.e., the angle with respect to the ground, or the angle with respect to the performer-user X) may be adjustable, for example by turning a knob, or the like (discussed later).

The operating device 1 may comprise a case 40 and an attachment number 30. The main body 11 of the electronic percussion instrument 10 may be operatively connected to the case 40, for example with a bracket 12*a*, or the like. Accordingly, the main body 11 may be supported by the case 40. In some embodiments, the bracket 12*a* may be shaped, for example, like a reversed squared "C" when viewed from a side.

The holding fixture 20 (or a supporting member) may be configured to support the case 40, and thus the electronic percussion instrument 10. In some embodiments, the holding fixture 20 may comprise a shoulder section. The shoulder section of the holding fixture 20 may be for allowing the performer-user X to wear or otherwise support the holding fixture 20. An end of the holding fixture 20 opposite the shoulder section of the holding fixture 20 may be connected to the attachment member 30. Accordingly, the performer-user X may be able to use the holding fixture 20 to hold the electronic percussion instrument 10, the attachment member 30, and the case 40. Thus, for example, allowing the performer-user X to be able to strike the pad 12 of the electronic percussion instrument 10 while marching, parading, or otherwise performing.

In one exemplary embodiment, the shoulder section of the holding fixture 20 may be shaped in a shape of a reverse letter "J" when viewed from a side. The end of the holding fixture 20 opposite the shoulder section of the holding fixture 20 may be "J"-shaped and may extend from the shoulder section of the holding fixture 20 and be attached to the attachment member 30.

The case 40 may be arranged between the holding fixture 20 and the electronic percussion instrument 10. In some embodiments, the case 40 may have a box-like shape, which may allow for maintaining rigidity of the case 40. The case 40 may house an electronic circuit K, which may be for processing the signal generated by striking the pad 12.

In some embodiments, the case 40 may be attached to the electronic percussion instrument 10. The case 40 and the attachment member 30 may be configured as a single unit. The attachment member 30 may be attached to the holding fixture 20. Thus, the electronic percussion instrument 10 may be operatively connected to the holding fixture 20 such that a performer-user X wearing the holding fixture 20 may be able to support the attached electronic percussion instrument 10. In other embodiments, the case 40 and the attachment member 30 are not configured as a single unit, but are connected together.

The main body 11 and the pad 12 of the electronic percussion instrument 10 may be arranged at a location that allows the performer-user X to easily strike the pad 12. For example, a space may be provided between the electronic percussion instrument 10 and the holding fixture 20. If the electronic percussion instrument 10 is too close to the performer-user X, the performer-user X may have difficulty striking the pad 12. Thus in some embodiments, the case 40 may be provided in the space between the holding fixture 20 and the electronic percussion instrument 10. In such embodiments, because the cause 40 may be arranged closer to the performer-user X than the electronic percussion instrument 10, buttons, switches, or the like provided on the case 40 (discussed later) are easily accessible to the performer-user X.

In some embodiments, portions of the electronic percussion instrument system 100 may be configured to be moveable or otherwise rotatable toward the performer-user X. For example, as shown by the double dotted dashed line in FIG. 2, the case 40 and the electronic percussion instrument 10 can be moved above the attachment member 30 by rotating the case 40 (and the electronic percussion instrument 10) upward toward the performer-user X relative to the attachment member 30. Accordingly, the case 40 and the electronic percussion instrument 10 may be placed in close proximity to the performer-user X. In some embodiments, the rotating shaft 41*b* may serve as a pivoting member to allow the case 40 and the electronic percussion instrument 10 to rotate or pivot up and down.

When the performer-user X is marching with or otherwise performing on the electronic percussion instrument system 100, the electronic percussion instrument system 100 may protrude in front of the performer-user a distance L2. When the case 40 and the electronic percussion instrument 10 are rotated upward relative to the attachment member 30 the electronic percussion instrument 10 may protrude in front of the performer a distance L3, which may be less than the distance L2. By reducing the distance L2 to the distance L3, visibility of the performer-user X may be improved.

Figure 3B:
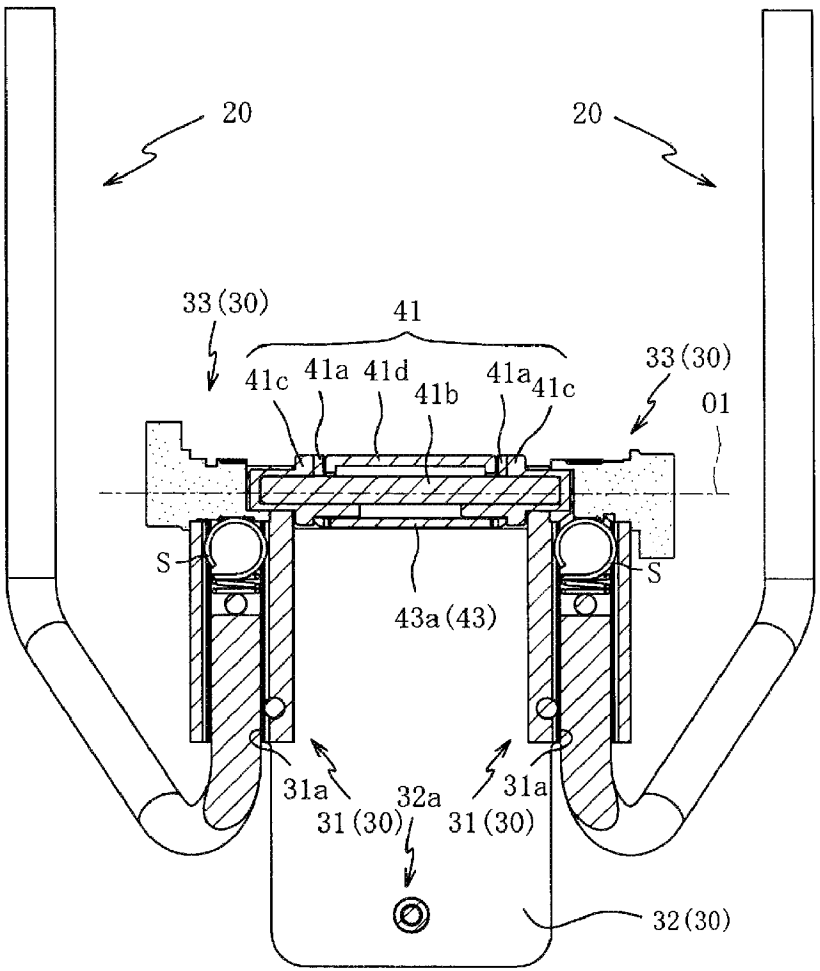
FIG. 3(*a*) illustrates an attachment member for an electronic percussion instrument system according to an embodiment of the present invention.
Figure 3A:
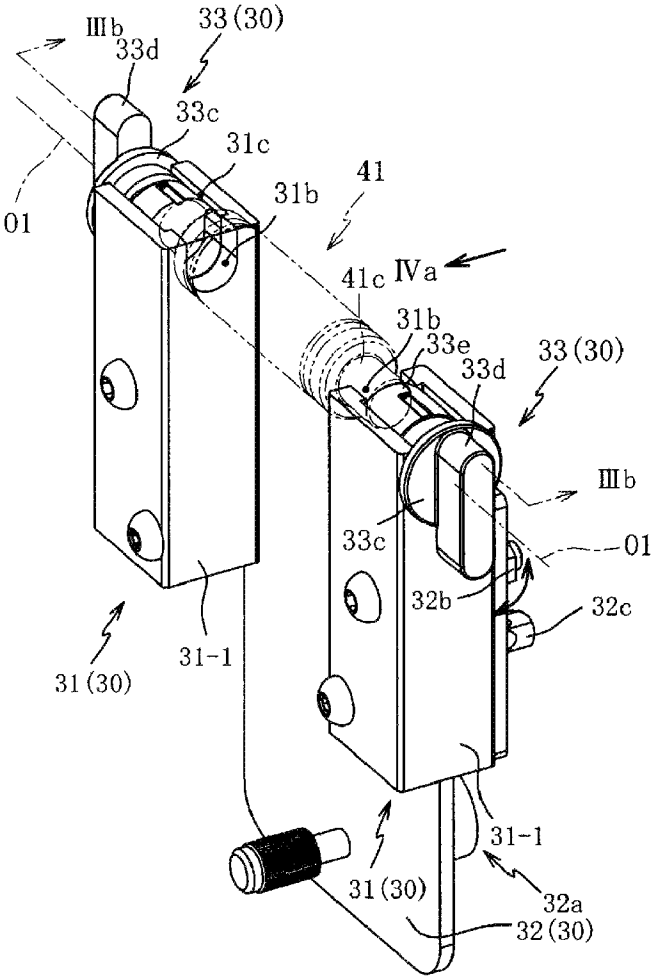

FIGS. 3(*a*), 3(*b*), 4(*a*), and 4(*b*) illustrate an example of the attachment member 30 and portions thereof according to an embodiment of the present invention. As discussed, the attachment member 30 may be for attaching the case 40 to the holding fixture 20. For example, the attachment member 30 may be linked to the end of the holding fixture 20 and may be held on the body of the performer-user X. In some embodiments, because dimensions of the holding fixture 20 may vary depending on the manufacturer, the attachment member 30 may serve as a universal adapter, or the like, to attach the case 40 to the holding fixture 20.

In some embodiments, the attachment member 30 may include, but is not limited to, a pair of holding sections 31, a plate section 32, and locking levers 33. The holding sections 31 may be attached to the holding fixture 20. The plate section 32 may be provided to connect the pair of holding sections 31. The adjusting levers 33 may be supported in the holding sections 31.

Because the pair of holding sections 31 and the fixing levers 33 may be identical on the left side and the right side, an explanation will be given regarding the holding section 31 and the locking lever on the left side in FIG. 3(*a*) and FIG. 3(*b*), while an explanation regarding the holding section 31 and the locking lever on the right side in FIG. 3(*a*) and FIG. 3(*b*) will be omitted.

With reference to FIGS. 3(*a*), 3(*b*), and 4(*a*), the holding section 31 may be a member of any suitable shape, such as a polygonal member, connected to the plate section 32. The holding section 31 may be configured to attach to the holding fixture 20. For example, the holding section may include an insertion hole 31*a* for inserting an end of the holding fixture 20. The holding section 31 may be for supporting a rotating shaft 41*b* (discussed later). For example, the holding section 31 may include a first groove 31*b*, in a shape of a "U", for supporting the rotating shaft 41*b*. In further embodiments, the holding section 31 may include a second groove 31*c* adjacent the first groove 31*b*. The second groove 31*c* may extend further into the holding section 31 than the first groove 31*b*. The second groove 31*c* may be for supporting the locking lever 33.

The plate section 32 may be attached or otherwise fastened to the rear surfaces of the holding sections 31, in any suitable manner, such as, but not limited to, bolts 32*b*, screws, or the like. The plate section 32 may include an adjusting bolt 32*a*, screw, or the like, to adjust an angle of the striking surface of the pad 12 (refer to FIG. 1) by turning the adjusting bolt 32*a*. For example, the adjusting bolt 32*a* may be inserted through a hole in the plate section 32. A shaft portion of the adjusting bolt 32*a* may be operatively connected to the case 40 such that adjustment of the adjusting bolt 32*a* changes the angle of the case 40, which changes the angle of the electronic percussion instrument 10 (refer to FIG. 1) and the attached pad 12 (refer to FIG. 1). The shaft portion of the adjusting bolt 32*a* may be configured and/or selected such that a length of the shaft portion of the adjusting bolt 32*a* in the axial direction may be adjustable.

In some embodiments, an end of the shaft portion of the adjusting bolt 32*a* may be in contact with the case 40 to further support the case 40 with the holding fixture 20. In some embodiments, the end of the shaft portion of the adjusting bolt 32*a* may be in contact with a padding section 49*a* (refer to FIG. 6) of the case 40.

In some embodiments, a bias member, such as a spring S or the like, may be configured to provide a bias force upon the locking lever 33. For example, the spring S may be housed in a first portion of the insertion hole 31*a*, while the end of the holding fixture 20 may be fitted in a second portion of the insertion hole 31*a* opposite the first portion of the insertion hole 31*a*.

The locking lever 33 may be supported by the holding section 31, for example in the second groove 31*c*. A bottom portion of the spring S may be in contact with the bolt 32*b*. The locking lever 33 may be biased toward a top end of the spring S (the top in FIG. 3(*b*)). The holding fixture 20 fitted in the insertion hole 31*a* may be inserted into the insertion hole 31*a* to a position in which the holding fixture 20 contacts the bolt 32*b*. The holding fixture 20 may be secured in the insertion hole 31*a*, for example with a screw, bolt, or the like.

The locking lever 33 may be positioned in the holding section 31. The locking lever 33 and/or the holding section 31 may be configured to prevent the locking lever 33 from falling out or out from the second groove 31*c*. For example, the second groove 31*c* may be further received into the holding section 31 than the first groove 31*b*. Therefore, the locking lever 33 may be placed in the second groove 31*c* (the upper left side in FIG. 3(*a*)) and abutted against the wall in which the first groove 31*b* is formed to prevent the locking lever 33 from falling out or otherwise passing through the first groove 31*b*.

In addition, the second groove 31*c* may have a cross section in a direction perpendicular to an axis O1 of the rotating shaft section 41. The second groove 31*c* may be formed in a shape of a circular arc that may surround at least half of an outer peripheral surface of the locking lever 33 when the locking lever 33 is in the second groove 31*c*, which may prevent the locking lever 33 from falling out or being otherwise removed out the top of the second groove 31*c* (i.e., in the direction perpendicular to the axis O1 of the rotating shaft 41*b*).

Figure 4:
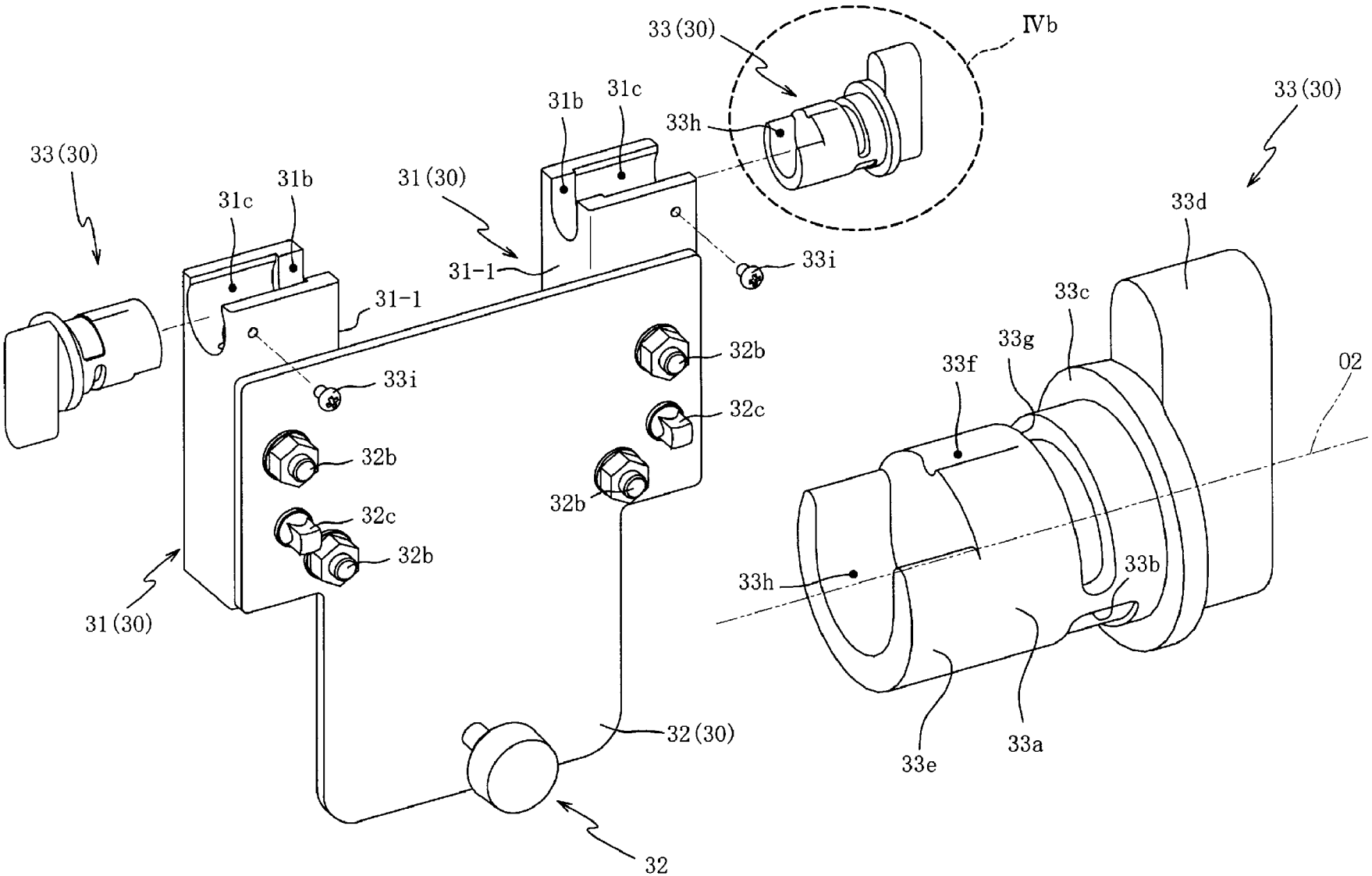
FIG. 4(*a*) illustrates the attachment member of FIG. 3(*a*) viewed from a direction of an arrow IVa in FIG. 3(*a*)

FIG. 4(*b*) illustrates the locking lever 33 according to an embodiment of the present invention. The locking lever 33 may be configured to retain a portion of the rotating shaft section 41 (refer to FIG. 3) in the second groove 31*c*. The locking lever 33 may have a main body 33*a*. The main body 33*a* may be cylindrically shaped and may have a diameter that is larger than a diameter of the rotating shaft 41*b* of the rotating shaft section 41 (refer to FIG. 3). The locking lever 33 may include a collar 33*c* attached to an end of the main body 33*a*. The collar 33*c* may have a diameter that is larger than the diameter of the main body 33*a*.

The locking lever 33 may include a protrusion, such as a knob 33*d*, or the like, attached to an end of the collar 33*c*, such that the collar 33*c* is positioned between the main body 33*a* and the knob 33*d*. In some embodiments, the knob 33*d* may be elliptically shaped, for example, with a short end and a long end. The knob 33*d* may be for allowing the performer-user X to grip the knob 33*d* and turn it clockwise or counter clockwise at least between a first position and a second position. In the first position, for example, the knob 33*d* may be perpendicular to the ground with the long end of the knob 33*d* located above the main body 33*a* of the locking lever 33 (the left knob 33*d* of FIG. 3(*a*)). In the second position, for example, the knob 33*d* may be perpendicular to the ground with the long end of the knob 33*d* located below the main body 33*a* of the locking lever (the right knob 33*d* of FIG. 3(*a*)).

The locking lever 33 may be configured to receive at least a portion of the rotating shaft section 41. For example, the locking lever 33 may include a receiving portion 33*e* located on an end of the main body 33*a* opposite from the end of the main body 33*a* attached to the collar 33*c*. The receiving portion 33*e* may be configured to receive a complementing portion 41*c* of the rotating shaft section 41. For example, the complementing portion 41*c* of the rotating shaft section 41 may be a pillow block, or the like, configured to be fitted into the receiving portion 33*e* of the locking lever 33. In some embodiments, at least one of the receiving portion 33*e* of the locking lever 33 and the complementing portion 41*c* of the rotating shaft section 41 may be made of metal, resin, or the like.

Accordingly, the locking lever 33 can be rotated with respect to the holding section 31 at least between the first position and the second position to lock and/or release the attachment member 30 to the case 40. When the locking lever 33 is in the first position (e.g., the long end of the knob 33*d* is above the main body 33*a* of the locking lever 33), a portion of the rotating shaft section 41 can be inserted into the holding section 31. In a case where the locking lever 33 is in the second position (e.g., the long end of the knob 33*d* is below the main body 33*a* of the locking lever 33) and the rotating shaft section 41 is inserted the holding section 31, the rotating shaft section 41 may be prevented from being removed from the second groove 31*c*. Thus, to lock the locking lever 33, the performer-user X may turn the knob 33*d* clockwise (or counter-clockwise) from the first position to the second position. The knob 33*d* shown on the right side in FIG. 3(*a*) illustrates a knob 33*d* in the second position (i.e., a locked position). In some embodiments, the knob 33*d* can be maintained in the second position with a bias force provided by the spring S or other suitable bias member.

With reference to FIG. 4(*b*), in some embodiments, the main body 33*a* may include a spring groove 33*f*, a positioning groove 33*g*, and an indicator groove 33*b*. The spring groove 33*f* may be a concavity formed on an outer surface of the main body 33*a* extending a specified length in the direction of the axis O2 of the main body 33*a*. The spring groove 33*f* may be for receiving the spring S (refer to FIG. 3(*b*)). The positioning groove 33*g* may be a semi-circular concavity formed on the outer surface of the main body 33*a* and may be positioned between the spring groove 33*f* and the collar 33*c*. The indicator groove 33*b* may be a semi-circular concavity formed on the outer surface of the main body 33*a* opposite from the positioning groove 33*g* with a cross-section that may be perpendicular to the axis of the main body section 33*a*.

In some embodiments, the locking lever 33 may be configured to be at least partially rotatable within the holding section 31 at least between the first position and the second position. For example, a fastener, such as a screw 33*i*, or the like, may be screwed into the rear surface of the holding section 31 to enter the positioning groove 33*g* of the locking lever 33. Accordingly, the locking lever 33 may be rotatable relative to the screw 33*i* with the positioning groove 33*g* moving along the screw 33*i*.

In further embodiments, the indicator groove 33*b* may include an indicator, such as a label (not shown) for indicating whether the fixed lever 33 is in the first position (e.g., unlocked position) or the second position (e.g., locked position). For example, as the locking lever 33 is rotated about the holding section 31, the indicator groove 33*b* may come into view allowing the performer-user X to look into the indicator groove 33*b* and see the now exposed label (not shown) to indicate that the locking lever 33 is locked (or unlocked).

In some embodiments, movement of the knob 33*d* to the second position may cause the spring S to engage the locking lever 33 to maintain the locking lever 33 in the second position. Accordingly, the spring S may be for applying a bias force against the locking lever 33. When the locking lever 33 is rotated to allow the spring S to contact the spring groove 33*f*, the spring S may be able to expand and engage the locking lever 33 at the spring groove 33*f* to retain the locking lever 33 in place.

In some embodiments, when the spring S engages the spring groove 33*f*, a sound may be produced, such as a clicking sound or a snapping sound. In further embodiments, a clicking sensation may be produced when the spring S engages the spring groove 33*f*. Accordingly, the performer-user X may be able to confirm the locking and releasing of the locking lever 33 (i.e., movement between the first and second positions).

Figures 5A, 5B, 5C:
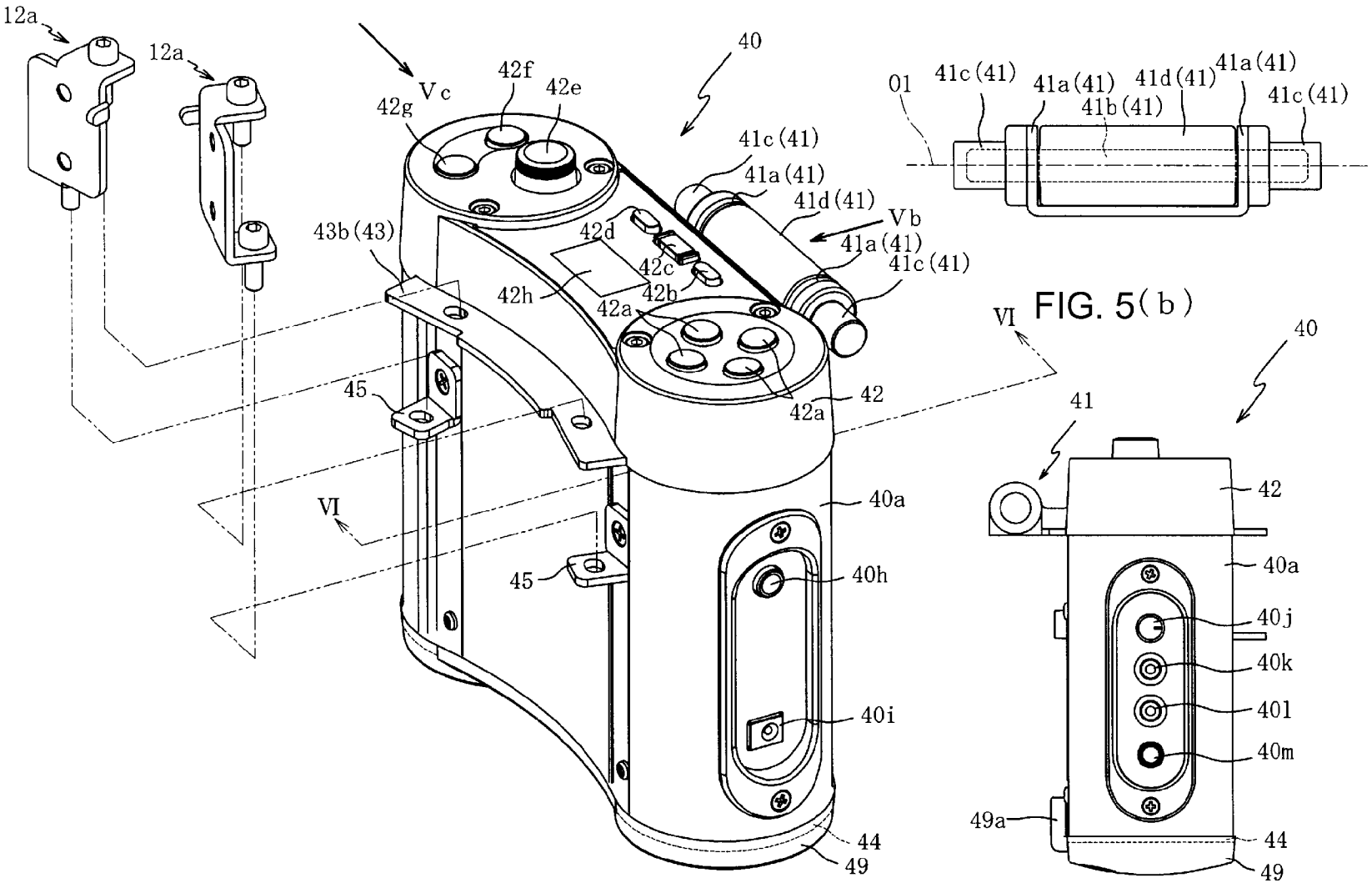
FIG. 5(*a*) illustrates a case according to an embodiment of the present invention.

FIGS. 5(*a*)-5(*c*) and 6 illustrate the case 40 according to an embodiment of the present invention. The case 40 may include a main body 40*a*. In some embodiments, the main body 40*a* of the case 40 may have a cylindrical shape. The main body 40*a* (or the case 40 in its entirety) may be formed from an extruded molded material. The material may be a metal, such as aluminum or the like.

In some embodiments, the case 40 may include an upper reinforcing plate 43 and a lower reinforcing plate 44 such that the main body 40*a* is arranged between the upper reinforcing plate 43 and the lower reinforcing plate 44. The upper reinforcing plate 43 and the lower reinforcing plate 43 may be attached or otherwise fastened in any suitable manner to the main body, such as with bolts 40*b*, screws, or the like.

The upper reinforcing plate 43 may be a rigid material, made of metal, or the like. For example, the upper reinforcing plate 43 may be a metal steel plate, such as a zinc-plated steel plate. The upper reinforcing plate 43 may have a flat plate section 43*a*, which may me formed in approximately a same size and configuration of the main body 40*a*. The upper reinforcing plate 43 may include a rear protrusion 43*c*, which may protrude from a rear side of the flat plate section 43*a* (i.e., a side closest to the performer-user X when the performer-user X is wearing the holding fixture 20, for example). The upper reinforcing plate 43 may include a front protrusion 43*b*, which may protrude from a front side of the flat plate section 43*a* (i.e., a side opposite the rear protrusion 43*c*).

In some embodiments, the flat plate section 43*a*, the front protrusion 43*b*, and the rear protrusion 43*c*, may be formed integral to one another. In such embodiments, because the flat plate section 43*a*, the rear protrusion 43*c*, which may be linked to the holding fixture 20, and the front protrusion 43*b*, which may be linked to the electronic percussion instrument 10, are formed integral to one another, the vibrations due to the striking of the pad 12 may be transmitted or otherwise distributed to the holding fixture 20 through the front protrusion 43*b*, the flat plate section 43*a*, and the rear protrusion 43*c*. This may substantially inhibit the vibrations from being transmitted to the main body 40*a* of the case 40 and any circuitry housed within the main body 40*a*.

In some embodiments, the rotating shaft section 41 may be operatively connected to the case 40. For example, a pair of support members 41*a* may extend upward from the rear protrusion 43*c* of the upper reinforcing plate 43. In some embodiments the support members 41*a* may be integral to the rear protrusion 43*c* of the upper reinforcing plate 43. The rotating shaft 41*b* may extend though the support members 41*a* such that the rotating shaft 41*b* may be able to rotate freely. For example, the support members 41*a* may each have an opening (in the direction of axis O1 of the rotating shaft 41) in which the rotating shaft 41*b* can be placed to support the rotating shaft 41*b*. In some embodiments, the flat plate section 43*a* may have an opening.

Each end of the rotating shaft 41*b* may include the complementing portion 41*c*, which as discussed may be inserted into the fixing lever 33. The portions of the ends of the rotating shaft 41*b* that protrude from the support members 41*a* may be fitted with the complementing portion 41*c*. In some embodiments, the complementing portion 41*c* may be roughly hat shaped (i.e., have a "U"-shaped cross-section). Accordingly, the complementing portion 41*c* may be supported by the first groove 31*b* of the holding section 31 and the receiving portion 33*e* of the locking lever 33 (refer to FIG. 3(*a*)).

An outer covering 41*d* may enclose at least a portion of the rotating shaft 41*b*, for example the portion of the rotating shaft 41*b* between the support members 41*a*. In some embodiments, the outer covering 41*d* may be formed integral to the operating panel 42. For example, the operating panel 42 and the outer covering 41*d* may be attached to the main body 40*a* of the case 40 as shown in FIG. 5(*a*).

As discussed in FIG. 1, the case 40 may be attached to the electronic percussion instrument, for example with brackets 12*a*. In some embodiments, the brackets 12*a* may be attached to attachment pieces 45, which may be attached to the case 40, in any suitable manner, such as with bolts, screws, or the like. For example, the brackets 12*a* may be arranged such that top surfaces of the attachment pieces 45 are in contact with bottom surfaces of the brackets 12*a*. In some embodiments, the brackets 12*a*, for example, may be attached to a top surface of the front protrusion 43*b*.

Figure 6:
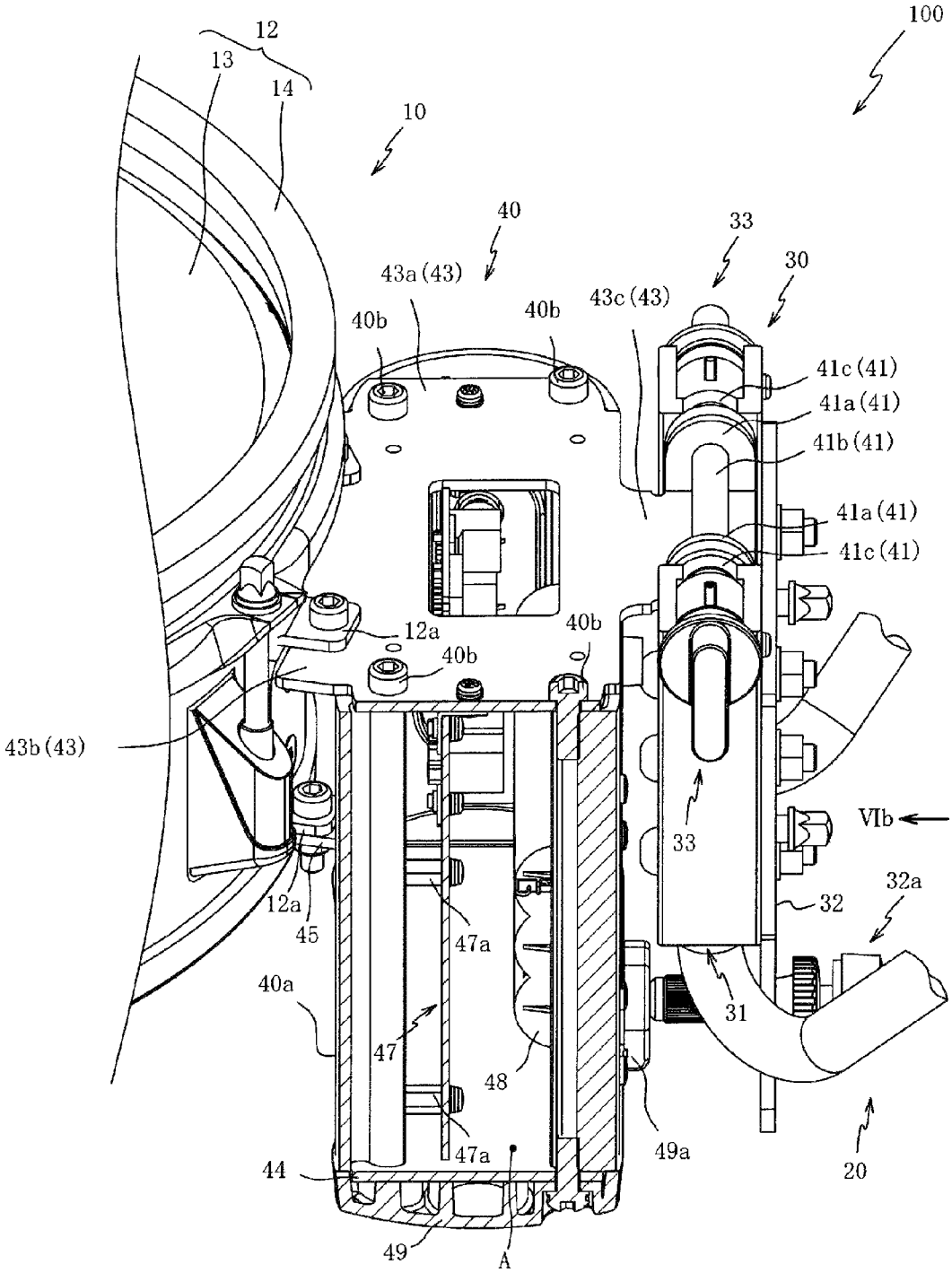
FIG. 6 is a cross-section drawing of the case of FIG. 5(*a*) viewed along a line VI-VI in FIG. 5(*a*)

With reference to FIG. 6, the case 40 may include a circuit board 47 and a battery (not shown) located within the main body 40*a* of the case 40. The battery (not shown) may be supported in a battery housing 48 that is disposed on an inside surface of the main body 40*a* of the case 40.

Figure 7:
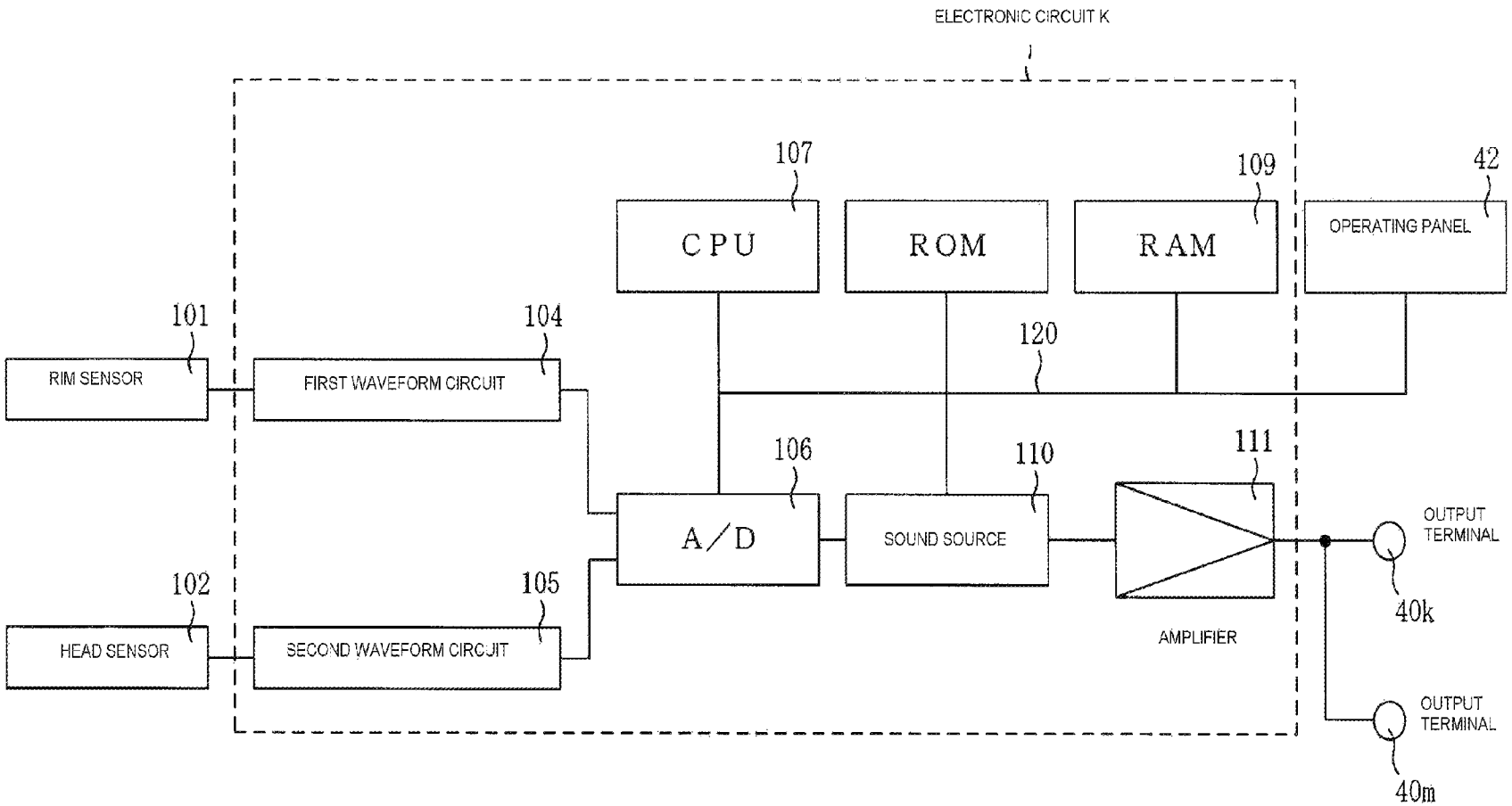
FIG. 7 is a block diagram showing an electrical configuration of an electronic percussion instrument according to an embodiment of the present invention.
Figure 8:
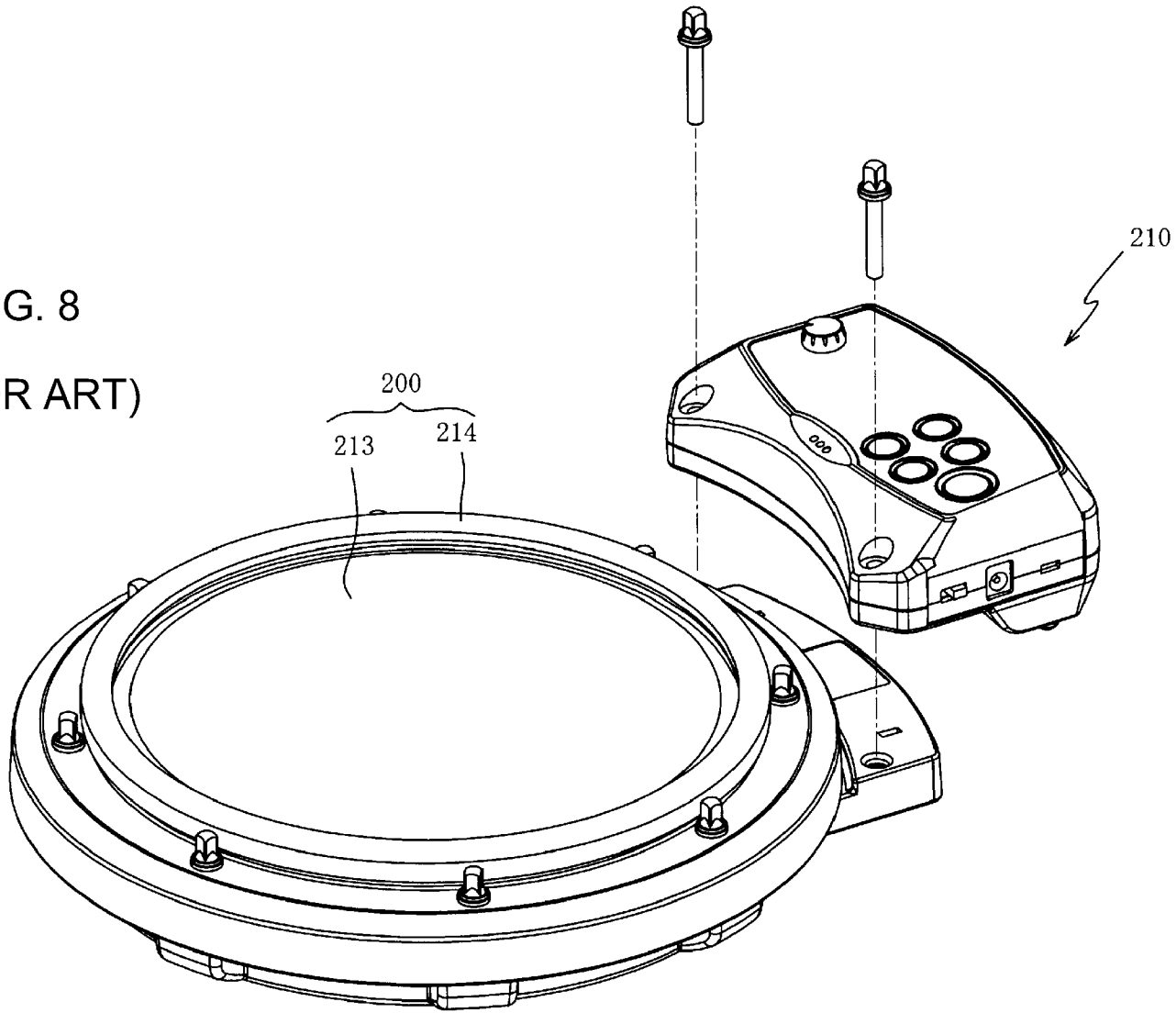
FIG. 8 (PRIOR ART)
FIG. 8 illustrates an example of a previous type of electronic percussion instrument and case.

The circuit board 47 may include an electronic circuit K (refer to FIG. 7). The circuit board 47 may be attached or otherwise fastened in any suitable manner to an inside surface of the case 40, for example with a plurality of bolts 47*a*, screws, or the like. In some embodiments, the circuit board 47 may be arranged on the inside surface of the main body 40*a* of the case 40 such that the circuit board 47 is perpendicular to the striking surface of the rim 14 (the head 13). In such embodiments, the circuit board 47 may be approximately perpendicular to a direction of vibrations produced from striking the pad 12 to mitigate damage to the circuit board 47 from said vibrations.

In addition, as is shown in FIG. 6, the case 40 may include a bottom member 49 that may be fit onto a lower portion of the main body 40*a*. The bottom member 49 may include the padding 49*a* (refer to FIG. 5(*c*)) that may extend away from the bottom member 49 and/or the main body 40*a* of the case 40. For example, the padding 49*a* may extend toward the performer-user X to prevent the performer-user X from contacting the rigid surface of the case 40.

In some embodiments, the case 40 may have a vertical dimension that is longer than a vertical dimension of the electronic percussion instrument 10 and a vertical dimension of the attachment member 30.

In some embodiments, the case 40 may include an operating panel 42 that may include a plurality of controls, such as, but not limited to, buttons, switches, knobs, sliders, and the like. For example, the operating panel 42 may include, but is not limited to, memory buttons 42*a*, an instrument button 42*b*, a power button 42*c* for turning on and off the power, a beat button 42*d*, a select knob 42*e* for selecting various parameters and the like, a metronome button 42*f* for turning on and off a metronome (not shown), a coach button 42*g* for toggling on and off a "coach" mode, and a display area 42*h*.

In some embodiments, the plurality of switches 42*a* to 42*g* may be arranged on a top surface of an operating panel 42. The plurality of switches 42*a* to 42*g* may be positioned lower than the top surface of the rim 14 (refer to FIG. 1), which may be the highest portion of the pad 12 (refer to FIG. 1). In some embodiments, the plurality of switches 42*a* to 42*g* may be positioned lower than the head 13 (refer to FIG. 1), which may be arranged below the rim 14 (refer to FIG. 1). Accordingly, accidental striking of one of the plurality of switches 42*a* to 42*g* may be inhibited.

In some embodiments, the operating panel 42 is configured having one or more memory buttons 42*a*. The memory buttons 42*a* may be for selecting various parameters, such as pitch, timbres and effects, and the like that correspond to each memory button 42*a*. The various parameters may be set and stored in advance.

The instrument button 42*b* may toggle between a live mode and a setting mode. In some embodiments, when the instrument button 42*b* is pressed for a certain period of time, such as less than three seconds, the setting mode may be set. The timbre and various other parameters may be set using the select knob 42*e*, for example. When the instrument button 42*b* is pressed for a greater period of time, such as three seconds or more, "live mode" may be initiated. In the live mode, for example, only the memory buttons 42*a* and the power button 42*c* may be operable. Accordingly, other functions, such as use of the metronome button 42*f*, the coach button 42*g*, or the like may be disabled.

The beat button 42*d* may allow for various kinds of parameters (e.g., beat, tempo, and the like) of the metronome mode to be edited. In some embodiments, when the beat button 42*d* is pressed continuously for a period of time, such as three to five seconds, the system edit mode may be initiated. In the system edit mode, it may be possible to edit various kinds of parameters (e.g., pad sensitivity, a threshold value for trigger detection, and the like). These various parameters may be set using the select knob 42*e*.

The coach button 42*g* may be for toggling on and off a coaching mode. In some embodiments, when the coach mode is initiated using the coach button 42*g*, various parameters may be displayed on the display screen 42*h*, such as striking force, striking timing matching the metronome, and the like. Accordingly, the performer-user X may be able to practice striking of the pad in conjunction with the coach mode.

With reference to FIG. 5, in some embodiment, the main body 40*a* may include a trigger in jack 40*h* for inputting the striking signal generated from striking the pad 12. The main body 40*a* may include a power supply jack, for example for a DC power supply voltage. The main body 40*a* may include volume controls, such as a headphone volume control 40*j*. The main body 40*a* may include a headphone jack 40*k* and/or other output jacks 40*m* for outputting musical tones to an external speaker or headphone. A cable (not shown) for connecting a speaker system with a built-in amplifier (not shown) may be connected to the output jack 40*m*.

FIG. 7 is a block diagram that shows an electrical configuration of the electronic percussion instrument 10. The electronic percussion instrument 10 may include, but is not limited to, a rim sensor 101 and a head sensor 102. The case 40 may include, but is not limited to, an input terminal (not shown), a first waveform producing circuit 104, a second waveform producing circuit 105, an A/D converter 106, a CPU 107, ROM 108, RAM 109, a sound source 110, an amplifier 111, and one or more output jacks 40*k*, 40*m*.

The A/D converter 106, the CPU 107, the ROM 108, the RAM 109, and the sound source 110 may be connected to a bus 120. The CPU 107 may be a processor for executing various control programs stored in the ROM 108. The ROM 108 may be memory that cannot be rewritten and that stores the various control programs.

The RAM 109 may be random access memory with a work area for temporarily storing variables and the like when the various control programs are executed by the CPU 107 and the like. In addition, the case 40 may include a pitch memory for storing pitches, and pitches of stored timbres, and the like that correspond to each of the memory buttons 42*a*. Incidentally, power may be supplied to the RAM 109 by the battery and the stored contents within may be maintained even when the power has been turned off by the power button 42*c*.

The rim sensor 101 and/or the head sensor 102 may be for detecting vibrations created by striking the electronic percussion instrument 10, for example, with a drumstick. A musical tone system (not shown) may control a sound source based on detection signals of the rim sensor 101 and/or the head sensor 102. Accordingly, the musical tone system (not shown) may be configured to generate a musical tone in conformance with a striking of the electronic percussion instrument 10. In some embodiments, the musical tone generated by the musical tone system (not shown) may be emitted from a speaker device (not shown) via an amplifier 111.

Electrical signals detected by each of the sensors 101 and 102 may be input respectively to the first waveform producing circuit 104 and the second waveform producing circuit 105 using a connecting cable, for example. The electrical signals may be detected by each of the waveform producing circuits 104 and 105. Envelopes may be extracted and the envelopes may be sampled at a specified sampling frequency and output to the A/D converter 106.

The sampled signals may be each quantized by the A/D (analog-digital) converter 106, and may be converted into digital signals, and output to the CPU 107. The CPU 107 may make a determination from the digital signals as to whether or not a striking has occurred. The CPU 107 may generate various information, such as velocity information and striking position information, note ON information, etc. The CPU 107 may output the various information to instruct a production of a musical tone to the sound source 110.

The sound source 110 may produce a sound, such as a percussion instrument sound, or the like in conformance with the note ON information, for example, inputted into the sound source 110. The musical tone waveforms for each of the percussion instruments and the like may be stored in the memory. The stored waveforms may be read out. In addition, frequency characteristics, amplitude, and the like may be controlled, and accordingly the musical tone may be produced.

In some embodiments, the musical tone signal outputted from the sound source 110 may be amplified by the amplifier 111 and may be outputted from the one or more output jacks 40*k*, 40*m*, such as a headphone jack, or the like.

With reference to FIGS. 1 and 2, in various embodiments, the attachment member 30 and the case 40 may be configured as separate units. In other embodiments, the attachment member 30 and the case 40 may be formed as a single unit. In such embodiments, for example, the case 40 may be attached to the attachment member 30

In various embodiments, the case 40 may be supported by the holding fixture 20 via the attachment member 30. In other embodiments, the case 40 may be attached directly to the holding fixture 20 without use of the attachment member 30.

In various embodiments, a musical tone may be produced from striking the pad 12. In other embodiments, the electronic percussion instrument system 100 may include a transmitter (not shown) for transmitting a striking signal produced from striking the pad 12 to a remotely located sound source system (not shown). In some embodiments, the transmitted signal may be a musical tone signal or a musical tone control digital signal, such as a MIDI, or the like, that is converted into a striking signal.

In some embodiments, the electronic percussion instrument system 100 may include a musical tone generation circuit (not shown), for example inside the pad 12. In further embodiments, the electronic percussion instrument system 100 may include an effector (not shown) for applying timbre and sound field changes to the musical tone signal from the pad 12.

The embodiments disclosed herein are to be considered in all respects as illustrative, and not restrictive of the invention. The present invention is in no way limited to the embodiments described above. Various modifications and changes may be made to the embodiments without departing from the spirit and scope of the invention. The scope of the invention is indicated by the attached claims, rather than the embodiments. Various modifications and changes that come within the meaning and range of equivalency of the claims are intended to be within the scope of the invention.

What is claimed is:

1. An operating device with an electronic percussion instrument comprising:

an electronic percussion instrument, the electronic percussion instrument comprising a pad;

a supporting member configured to be supported by a user;

a case arranged between the supporting member and the electronic percussion instrument;

an electronic circuit provided within the case, the electronic circuit for processing a signal produced by striking a striking surface of the pad of the electronic percussion instrument;

an instrument attachment member for operatively connecting the electronic percussion instrument to the case;

a supporting member attachment member for operatively connecting the supporting member to the case; and a circuit board containing the electronic circuit;

the case having a main body;

the circuit board arranged within the main body of the case such that the circuit board is approximately perpendicular to the striking surface of the pad;

the case further comprising an upper reinforcing plate and a lower reinforcing plate;

the main body of the case having a top opening and a bottom opening, the upper reinforcing plate for covering the top opening of the main body of the case, the lower reinforcing late for covering the bottom opening of the main body of the case, the upper reinforcing plate and the lower reinforcing plate parallel to the striking surface of the pad;

wherein the main body of the case is supported between the upper reinforcing plate and the lower reinforcing plate.

2. The operating device of claim 1, the operating device further comprising:

an operating panel provided on the case, the operating panel having a plurality of controls.

3. The operating device of claim 2, wherein the plurality of controls are arranged on the operating panel at a position lower than the striking surface of the pad.

4. The operating device of claim 1, wherein the instrument attachment member, the supporting member attachment member, and the upper reinforcing plate are formed as a single unit.

5. A musical instrument system comprising:

a percussion instrument, the percussion instrument comprising a striking surface;

a supporting member configured to be supported by a user;

a casing arranged between the supporting member and the percussion instrument, the casing operatively connected to the percussion instrument and the supporting member;

and an electronic circuit provided within the casing, the electronic circuit for processing a signal produced by striking the striking surface of the percussion instrument; and a circuit board containing the electronic circuit;

the case having a main body;

the circuit board arranged within the main body of the case such that the circuit board is approximately perpendicular to the striking surface of the percussion instrument;

the case further comprising an upper reinforcing plate and a lower reinforcing plate;

the main body of the case having a top opening and a bottom opening, the upper reinforcing plate for covering the top opening of the main body of the case, the lower reinforcing plate for covering the bottom opening of the main body of the case, the upper reinforcing plate and the lower reinforcing plate parallel to the striking surface of the percussion instrument;

wherein the main body of the case is supported between the upper reinforcing plate and the lower reinforcing plate.

6. The musical instrument system of claim 5, wherein the percussion instrument and the casing are configured to be moveable relative to the supporting member.

7. The musical instrument system of claim 5, the musical instrument system further comprising:

an attachment member for operatively connecting the percussion instrument to the casing.

8. The musical instrument system of claim 5, the musical instrument system further comprising:

an attachment member for operatively connecting the supporting member to the casing.

9. The musical instrument system of claim 5, wherein the supporting member is configured to be worn by the user.

10. The musical instrument system of claim 5, the casing comprising an operating panel having a plurality of controls.

11. The musical instrument system of claim 10, wherein the plurality of controls are arranged at a position lower than the striking surface of the percussion instrument.

12. The musical instrument system of claim 5:

wherein the circuit board has a longitudinal dimension;

wherein the circuit board is arranged within the casing such that the longitudinal dimension of the circuit board is approximately perpendicular to the striking surface of the percussion instrument.

13. The musical instrument system of claim 5, wherein the percussion instrument is an electronic percussion instrument.

14. The musical instrument system of claim 5, wherein the percussion instrument comprises a pad.

15. The musical instrument system of claim 5, the supporting member configured to be carried by the user to allow the user to carry the musical instrument system during operation of the musical instrument system.

16. The musical instrument system of claim 5, the supporting member shaped to fit over one or more shoulders of the user.

17. The musical instrument of claim 16, the supporting member configured to be "J"-shaped.

18. A method of making a musical instrument system, the method comprising:

providing a percussion instrument, the percussion instrument comprising a striking surface;

providing a supporting member configured to be supported by a user;

arranging a casing between the supporting member and the percussion instrument, the casing operatively connected to the percussion instrument and the supporting member;

providing an electronic circuit within the casing, the electronic circuit for processing a signal produced by striking the striking surface of the percussion instrument;

providing an upper reinforcing plate on an upper portion of the casing, the upper reinforcing plate parallel to the striking surface of the percussion instrument; and providing a lower reinforcing plate on a lower portion of the casing;

wherein the casing is supported between the upper reinforcing plate and the lower reinforcing plate.

19. The method of claim 18, the method further comprising:

providing an operating panel on the casing, the operating panel having a plurality of controls arranged at a position lower than the striking surface of the percussion instrument.

20. The method of claim 18, the method further comprising:

supporting the electronic circuit on a circuit board; and supporting the circuit board in the casing such that the circuit board is approximately perpendicular to the striking surface of the percussion instrument.

21. An operating device with an electronic percussion instrument comprising:

an electronic percussion instrument, the electronic percussion instrument comprising a pad;

a supporting member configured to be supported by a user;

a case arranged between the supporting member and the electronic percussion instrument, the case having a main body having a top opening and a bottom opening, the case comprising:

an upper reinforcing plate for covering the top opening of the main body of the case; and a lower reinforcing plate for covering the lower reinforcing plate for covering the bottom opening of the main body of the case, the upper reinforcing plate and the lower reinforcing plate parallel to the striking surface of the pad;

wherein the main body of the case is supported between the upper reinforcing plate and the lower reinforcing plate;

an electronic circuit provided within the case, the electronic circuit for processing a signal produced by striking a striking surface of the pad of the electronic percussion instrument;

an instrument attachment member for operatively connecting the electronic percussion instrument to the case;

a supporting member attachment member for operatively connecting the supporting member to the case; and a circuit board containing the electronic circuit, the circuit board arranged within the main body of the case such that the circuit board is approximately perpendicular to the striking surface of the pad.

22. A method of making a musical instrument system, the method comprising:

providing a percussion instrument, the percussion instrument comprising a striking surface;

providing a supporting member configured to be supported by a user;

arranging a casing between the supporting member and the percussion instrument, the casing operatively connected to the percussion instrument and the supporting member;

providing an electronic circuit within the casing, the electronic circuit for processing a signal produced by striking the striking surface of the percussion instrument;

providing an upper reinforcing plate on an upper portion of the casing, the upper reinforcing plate parallel to the striking surface of the percussion instrument; and providing a lower reinforcing plate on a lower portion of the casing;

wherein the casing is supported between the upper reinforcing plate and the lower reinforcing plate.

23. An operating device with an electronic percussion instrument comprising:

an electronic percussion instrument, the electronic percussion instrument comprising a pad;

a supporting member configured to be supported by a user;

a case arranged between the supporting member and the electronic percussion instrument;

an electronic circuit provided within the case, the electronic circuit for processing a signal produced by striking a striking surface of the pad of the electronic percussion instrument;

an instrument attachment member for operatively connecting the electronic percussion instrument to the case;

a supporting member attachment member for operatively connecting the supporting member to the case; and an operating panel provided on the case, the operating panel having a plurality of controls;

wherein the plurality of controls are arranged on the operating panel at a position lower than the striking surface of the pad; and wherein the instrument attachment member, the supporting member attachment member, and the upper reinforcing plate are formed as a single unit.

* * * * *